US011549311B2

(12) United States Patent
Sönnecken

(10) Patent No.: US 11,549,311 B2
(45) Date of Patent: Jan. 10, 2023

(54) ROTARY DRIVE ARRANGEMENT FOR A DRILL ROD

(71) Applicant: EURODRILL GmbH, Drolshagen (DE)

(72) Inventor: Ralf Sönnecken, Meinerzhagen (DE)

(73) Assignee: EURODRILL GmbH, Drolshagen (DE)

( * ) Notice: Subject to any disclaimer, the term of this patent is extended or adjusted under 35 U.S.C. 154(b) by 0 days.

(21) Appl. No.: 17/569,648

(22) Filed: Jan. 6, 2022

(65) Prior Publication Data

US 2022/0228439 A1 Jul. 21, 2022

(30) Foreign Application Priority Data

Jan. 21, 2021 (EP) ..... 21152803

(51) Int. Cl.
*E21B 4/00* (2006.01)
*E21B 3/00* (2006.01)

(52) U.S. Cl.
CPC ..... *E21B 4/006* (2013.01); *E21B 3/00* (2013.01)

(58) Field of Classification Search
CPC ..... E21B 4/006
See application file for complete search history.

(56) References Cited

U.S. PATENT DOCUMENTS

2013/0292179 A1* 11/2013 Pikowski ..... E21B 6/04 175/56
2020/0300041 A1* 9/2020 Jostes ..... E21B 3/022

FOREIGN PATENT DOCUMENTS

DE 4402487 A1 * 7/1995 ..... E21B 3/02
DE 199 06 687 A1 8/2000
EP 1 124 037 A1 8/2001
EP 1 936 109 B1 5/2009
EP 2 634 363 A1 9/2013

OTHER PUBLICATIONS

DE19906687 Translation (Year: 2022).*

* cited by examiner

*Primary Examiner* — Giovanna Wright
(74) *Attorney, Agent, or Firm* — Studebaker & Brackett PC

(57) ABSTRACT

The invention relates to a rotary drive arrangement for a drill rod having an outer pipe and an inner rod running at least in sections inside the outer pipe, in particular for double-head and/or overburden drilling, with a first gearbox for driving the inner rod in a rotating manner and a second gearbox for driving the outer pipe in a rotating manner, wherein the first gearbox and the second gearbox are independent of each other. According to the invention provision is made in that the first gearbox and the second gearbox are supported in a common gearbox housing and are surrounded by the same.

10 Claims, 1 Drawing Sheet

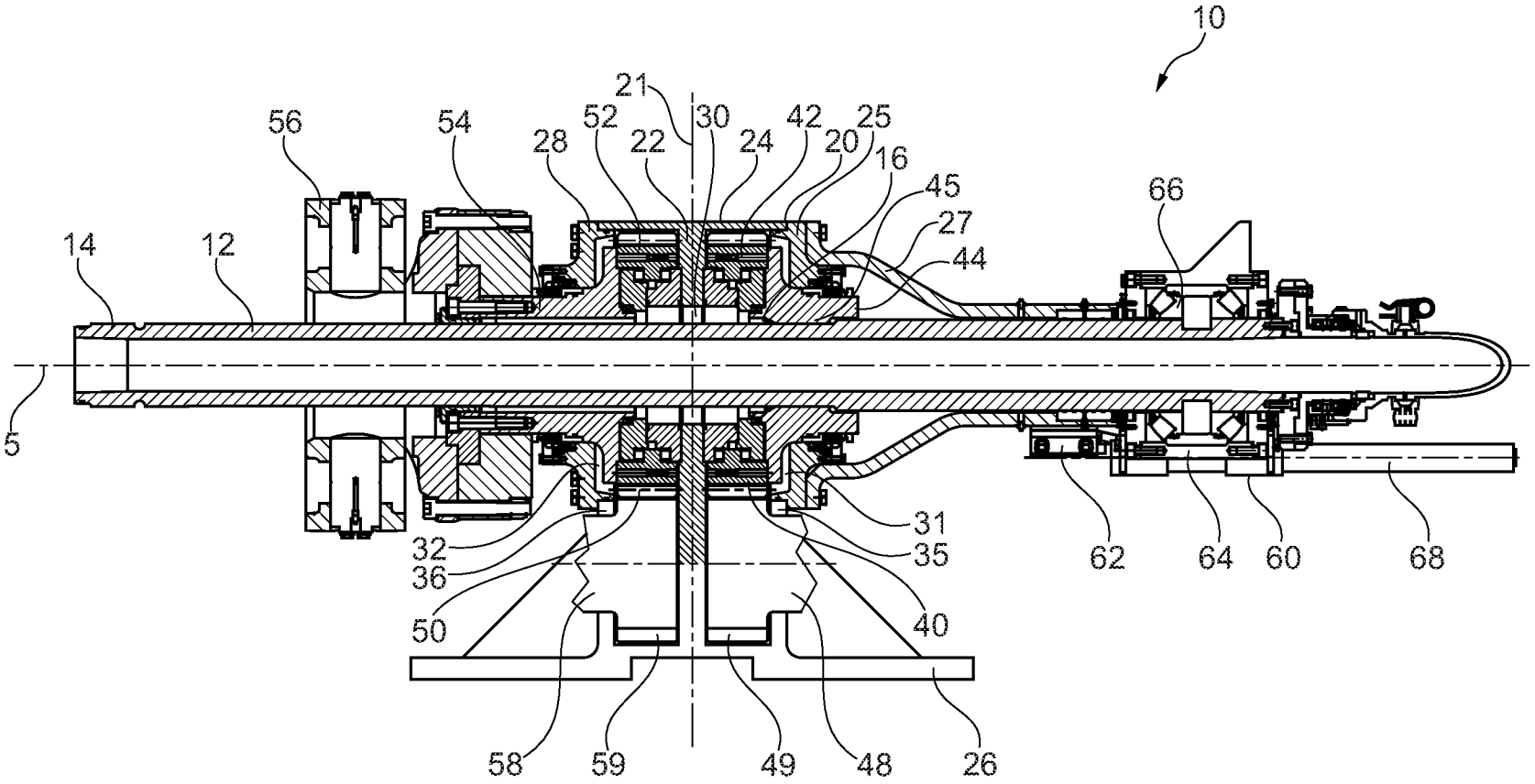
10
66
68
60
64
62
26
48
49
59
58
50
36
32
40
35
31
44
27
45
16
25
20
42
24
30
22
21
52
28
54
56
12
14
5

ROTARY DRIVE ARRANGEMENT FOR A DRILL ROD

TECHNICAL FIELD

The invention relates to a rotary drive arrangement for a drill rod having an outer pipe and an inner rod running at least in sections inside the outer pipe, in particular for double-head and/or overburden drilling, with a first gearbox for driving the inner rod in a rotating manner and a second gearbox for driving the outer pipe in a rotating manner, wherein the first gearbox and the second gearbox are independent of each other, in accordance with the preamble of claim 1.

BACKGROUND

A rotary drive arrangement of such type is known from EP 1 936 109 B1 for example. In this known rotary drive arrangement an overall compact construction is achieved in that a total of three rotary drives are provided above an approximately annular gearbox unit for driving the inner rod. An annular gearbox unit for driving the outer pipe is arranged below and at a distance to the gearbox unit for the inner rod. The spaced apart gearbox units are connected to each other via struts.

Such rotary drive arrangements are used in drilling apparatuses to drive a drill rod for double-head drilling or overburden drilling. The drill rod has an inner rod with a drilling tool and, surrounding the inner rod coaxially, an outer pipe with another annular drilling tool. The inner rod and the outer pipe can be driven in the same or in an opposite direction with the same or a different torque and rotational speed. As a result, boreholes can be produced efficiently in the ground or in rock.

SUMMARY

The invention is based on the object to specify a rotary drive arrangement for a drill rod which, whilst being of compact construction, enables a particularly efficient use.

The object is achieved by a rotary drive arrangement having the features of claim 1. Preferred embodiments of the invention are stated in the dependent claims.

The rotary drive arrangement according to the invention is characterized in that the first gearbox and the second gearbox are supported in a common gearbox housing and are surrounded by the same.

As a result, a particularly compact rotary drive arrangement is achieved. This minimizes the expenditure of material required in manufacturing and reduces the overall weight of the rotary drive arrangement. This has considerable advantages when in use on a drilling apparatus. Since the rotary drive arrangement is usually to be moved along a vertical mast that can have a length of 10 to 20 meters or more the reduction in weight of the rotary drive arrangement displaceably supported thereon signifies an increase in the tilt resistance of the apparatus. In addition, a more compact construction can effectively lead to a larger displacement distance of the drill rod.

When extracting the drill rod from a borehole the rotary drive arrangement has to be withdrawn by a pulling means, usually a winch. A reduction in weight of the rotary drive arrangement therefore also brings about a reduction of the load during extraction, whereby the application of a greater pull force onto the drill rod and therefore a more efficient drilling operation is rendered possible.

A preferred embodiment of the invention resides in the fact that the gearbox housing has a center support which runs approximately perpendicularly to the drilling axis and divides the gearbox housing into a first gearbox compartment which faces away from the drilling tool side and a second gearbox compartment which faces towards the drilling tool side. Due to the arrangement of such a center support the two gearboxes can be arranged such that they are functionally separated further away from each other whereat by arranging the gearboxes on both sides on the center support a good force distribution is achieved which leads to a particularly stable housing construction.

A preferred further development of the invention resides in the fact that the center support has a passage for the inner rod. In this way, the inner rod can protrude from the drilling tool side further to the rear through the center support. Via the passage the two gearbox compartments can be in fluid connection e.g. for a joint gearbox oil filling. On the rear side facing away from the drilling tool side the gearbox housing can be sealed off with respect to the inner rod by a simple sealing means. The gearbox housing can be sealed off on the one hand towards the drilling tool side by a sealing means with respect to the inner rod and on the other hand by a further sealing means with respect to the outer rod or the output unit for the outer rod.

According to an embodiment of the invention it is particularly expedient that the first gearbox for driving the inner rod is arranged in the first gearbox compartment and the second gearbox for driving the outer pipe is arranged in the second gearbox compartment. In particular, this arrangement provides the possibility of displacement of the inner rod with respect to the outer pipe, in which case the inner rod can be moved towards the rear side relative to the gearbox housing. Due to this displaceability of the inner rod relative to the outer pipe a drilling tool on the inner rod can be arranged at the same height relative to a drilling tool on the outer rod or, depending on the respective drilling method, can be arranged hurrying on ahead or lagging with respect thereto.

According to a further development the compactness of the rotary drive arrangement is improved further in that the gearbox housing has at least one first inlet opening for at least one first drive shaft of at least one first rotary drive and at least one second inlet opening for at least one second drive shaft of at least one second rotary drive. By preference, two drive shafts are provided for the outer pipe and one drive shaft for the inner rod. However, two or several drive shafts can in each case also be provided for the outer pipe and the inner rod. Basically, the inner rod could also be driven by means of two drive shafts while the outer pipe is only driven by a single drive shaft.

In this arrangement a compactness and force distribution are still improved in that the at least one first inlet opening is located on one side of the center support and in that the at least one second inlet opening is designed on an opposite side of the center support in the gearbox housing. By preference, the inlet openings for the drive shafts in the gearbox housing are located thereby in a region in the gearbox housing that lies between the drilling axis and the mast or rig, on which the rotary drive arrangement is arranged.

According to a further embodiment of the invention a particularly good force transmission is accomplished in that the first gearbox has a first spur gearwheel and/or the second gearbox has a second spur gearwheel which are each rotatably supported in the gearbox housing. The respective spur gearwheel can be in meshing connection via a corresponding toothing on a drive pinion of the respective drive shaft.

In conjunction with this it is especially expedient that on the first spur gearwheel a first output element is arranged for driving the inner rod, the said first output element being connected in a torque-proof but axially displaceable manner to the inner rod. Hence, designed on an external side of the inner rod are external teeth with a certain axial extension which is of greater length than a width of the spur gearwheel, whereby an axial displacement of the first spur gearwheel relative thereto is rendered possible. As a result, the inner rod can be displaced axially relative to the first gearbox whilst further is enabled a torque transmission at the same time.

Another preferred embodiment of the invention resides in the fact that on the second spur gearwheel a second output element is mounted for driving the outer pipe, on which second output element the outer pipe can be mounted in a torque-proof manner. Here, the second output element is in particular a flange-like attachment element, on which an outer pipe, more particularly a drill pipe, can be releasably mounted.

According to a further development of the invention an especially compact construction is still achieved in that the gearbox housing is arranged on a base plate, on which the rotary drives are also arranged. Thus, the rotary drive arrangement can be provided as a unit together with the rotary drives.

Another preferred embodiment variant of the rotary drive arrangement according to the invention resides in the fact that on an external side of the gearbox housing a displacement means is arranged, which is connected in an axially fixed but rotatable manner to the inner rod for axial displacement of the inner rod relative to the gearbox housing. The displacement means can in particular have a positioning cylinder, more particularly a hydraulic positioning cylinder. The displacement means is on the one hand retained on the gearbox housing and is firmly connected thereto. Via a rotary bearing the displacement means is preferably connected to the rotationally driven inner rod so that the inner rod continues to be rotatable relative to the displacement means. By preference, the displacement means is located for this purpose on the rear side of the gearbox housing facing away from the drilling tool side.

The invention furthermore comprises a drilling apparatus having a mast or a rig, along which a drill drive carriage is supported in a displaceable manner, wherein on the drill drive carriage the rotary drive arrangement according to the invention is arranged such as was described previously. By means of a cable pull system or by way of positioning cylinders the drill drive carriage is here displaceably supported along a vertical mast or a rig that can be adjusted about several axes in space. In particular, on the drill drive carriage the rotary drive arrangement with the base plate can be arranged together with the rotary drives.

BRIEF DESCRIPTION OF THE DRAWING

The invention is explained in greater detail hereinafter by way of a preferred exemplary embodiment illustrated in the accompanying FIGURE. The FIGURE shows a schematic cross-sectional view through a rotary drive arrangement according to the invention.

DETAILED DESCRIPTION

The illustrated rotary drive arrangement 10 serves to drive a non-depicted double drill rod about a drilling axis 5, with only a part of the inner rod 12 being illustrated. On the inner rod 12 further inner rod elements can be releasably mounted via a connecting section 14 towards a drilling tool side. On a connecting element 56 of the rotary drive arrangement 10 a non-depicted outer pipe can be releasably attached in a manner coaxial with respect to the drilling axis 5.

The rotary drive arrangement 10 comprises a gearbox housing 20 with a center support 22 which is designed along a center plane 21 located orthogonally to the drilling axis 5. The center support 22 is firmly connected to a base plate 26, with which the rotary drive arrangement 10 can be fixed e.g. on a non-depicted drill drive carriage of a drilling apparatus.

On the center support 22 a circumferential wall section 24 running on both sides is designed, on which, towards a rear side facing away from the drilling tool, a first side cover 25 is attached, whereby a first gearbox compartment 31 with a first gearbox 40 for driving the inner rod 12 is encased. On the opposite side of the center support 22 a second side cover 28 is mounted on the circumferential wall section 24, by which second side cover a second gearbox compartment 32 with a second gearbox 50 for driving the outer pipe is encased. The center support 22 has a centrally arranged passage 30, through which the inner rod 12 protrudes from the drilling tool side through the center support 22 towards a rear side.

To drive the inner rod 12 a non-depicted first rotary drive with a first drive shaft 48 is arranged on the base plate 26, the said first drive shaft protruding through a first inlet opening 35 into the gearbox housing 20. On the first drive shaft 48 a first pinion 49 is designed which is in meshing connection with a first externally toothed spur gearwheel 42 of the first gearbox 40. On a side of the first spur gearwheel 42 facing away from the center support 22 a sleeve-shaped first output element 44 is mounted. On its internal side the sleeve-shaped first output element 44 has an internal toothing 45 which engages with an external toothing 16 on the inner rod 12. The external toothing 16 is of greater axial length than the internal toothing 45, thereby providing a torque-proof connection concomitant with axial displaceability of the inner rod 12 with respect to the first gearbox 40.

For axial displacement of the inner rod 12 a displacement means 60 is arranged on a sleeve-like housing shoulder 27 which follows the first side cover 25 and is fixed thereon. The said displacement means has a fixing element 62 which is firmly mounted on the external side of the housing shoulder 27. In addition, a sleeve-shaped carriage 64 is provided which is connected via a rotary bearing 66 in an axially fixed but rotatable manner to the inner rod 12. Via a non-depicted lifting cylinder the carriage 64, and therefore the inner rod 12, can be adjusted relatively axially with respect to the fixing element 62 and therefore with respect to the gearbox housing 20, in which case a bar-shaped linear guide 68 is arranged as anti-twist protection.

Moreover, the inner rod 12 can be of pipe-shaped design, wherein via a generally known rotary feedthrough at the rear end of the inner rod 12 a fluid, in particular concrete slurry, can be fed to the drilling tool side.

On the opposite side of the center support 22 the second gearbox 50 for driving the non-depicted outer pipe is arranged. For this a non-depicted second rotary drive with a second drive shaft 58 is arranged on the base plate 26. The second drive shaft 58 protrudes through a second inlet opening 36 into the gearbox housing 20. Via a second pinion 59 on the second drive shaft 58 a torque can be transmitted to a second spur gearwheel 52 of the second gearbox 50. On a side of the second spur gearwheel 52 facing away from the center support 22 a sleeve-shaped second output element 54 is mounted, on which, for the purpose of mounting the outer pipe of the double drill rod, a Cardanic connecting element 56 is mounted in a torque-proof manner via a transfer ring 55.

The inner rod 12 protrudes through the second output element 54. The respective ring-shaped gaps on the housing passages are sealed off by appropriate ring sealings in order to close the gearbox housing 20 in an oil-tight manner.

By way of the invention two from one another separate gearboxes 40, 50 are arranged in one gearbox housing 20 and are encased by the same in an oil-tight manner. As a result, an altogether compact rotary drive arrangement 10 is achieved.

The invention claimed is:

1. A rotary drive arrangement for a drill rod having an outer pipe and an inner rod running at least in sections inside the outer pipe, in particular for double-head and/or overburden drilling, with a first gearbox for driving the inner rod in a rotating manner and a second gearbox for driving the outer pipe in a rotating manner, wherein the first gearbox and the second gearbox are independent of each other, wherein the first gearbox and the second gearbox are supported in a common gearbox housing and are surrounded by the same, and on an external side of the gearbox housing a displacement means is arranged which is connected in an axially fixed but rotatable manner to the inner rod for axial displacement of the inner rod relative to the gearbox housing.

2. The rotary drive arrangement according to claim 1, wherein the gearbox housing has a center support which runs approximately perpendicularly to the drilling axis and divides the gearbox housing into a first gearbox compartment which faces away from a drilling tool side and a second gearbox compartment which faces towards the drilling tool side.

3. The rotary drive arrangement according to claim 2, wherein the center support has a passage for the inner rod.

4. Rotary drive arrangement according to claim 2, wherein the first gearbox for driving the inner rod is arranged in the first gearbox compartment and the second gearbox for driving the outer pipe is arranged in the second gearbox compartment.

5. The rotary drive arrangement according to claim 1, wherein the gearbox housing has at least one first inlet opening for at least one first drive shaft of at least one first rotary drive and at least one second inlet opening for at least one second drive shaft of at least one second rotary drive.

6. The rotary drive arrangement according to claim 5, wherein the at least one first inlet opening is located on one side of the center support and the at least one second inlet opening is designed on an opposite side of the center support in the gearbox housing.

7. The rotary drive arrangement according to claim 5, comprising a base plate on which the gearbox housing, the at least one first rotary drive, and the at least one second rotary drive are arranged.

8. The rotary drive arrangement according to claim 1, wherein the first gearbox has a first spur gearwheel and/or the second gearbox has a second spur gearwheel which are each rotatably supported in the gearbox housing.

9. The rotary drive arrangement according to claim 8, wherein on the first spur gearwheel a first output element is arranged for driving the inner rod, the said first output element being connected in a torque-proof but axially displaceable manner to the inner rod.

10. The rotary drive arrangement according to claim 8, wherein on the second spur gearwheel a second output element is mounted for driving the outer pipe, on which second output element the outer pipe can be mounted in a torque-proof manner.

* * * * *